US009115723B2

(12) United States Patent
Lin et al.

(10) Patent No.: US 9,115,723 B2
(45) Date of Patent: Aug. 25, 2015

(54) COOLING FAN WITH IMPELLER

(75) Inventors: Yu-Ching Lin, New Taipei (TW); Ming-Hsiu Chung, New Taipei (TW); Wen-Cheng Chen, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 429 days.

(21) Appl. No.: 13/532,812

(22) Filed: Jun. 26, 2012

(65) Prior Publication Data

US 2013/0309094 A1 Nov. 21, 2013

(30) Foreign Application Priority Data

May 21, 2012 (TW) ..... 101117975 A

(51) Int. Cl.
*F04D 29/28* (2006.01)
*F04D 25/06* (2006.01)
*F04D 29/62* (2006.01)

(52) U.S. Cl.
CPC ..... *F04D 25/0613* (2013.01); *F04D 29/281* (2013.01); *F04D 29/626* (2013.01)

(58) Field of Classification Search
CPC .. F04D 29/281; F04D 29/626; F04D 25/0613
USPC ..... 416/204 R, 234, 246; 415/85, 911, 912
See application file for complete search history.

(56) References Cited

U.S. PATENT DOCUMENTS

| | | | | |
|---|---|---|---|---|
| 1,377,827 | A * | 5/1921 | Garela | 416/193 R |
| 7,455,504 | B2 * | 11/2008 | Hill et al. | 416/179 |
| 2007/0114869 | A1 * | 5/2007 | Horng et al. | 310/156.32 |
| 2007/0212219 | A1 * | 9/2007 | Teshima et al. | 415/206 |
| 2010/0232931 | A1 * | 9/2010 | Yu et al. | 415/115 |
| 2013/0052001 | A1 * | 2/2013 | Su et al. | 415/203 |

* cited by examiner

*Primary Examiner* — Nathaniel Wiehe
*Assistant Examiner* — Woody A Lee, Jr.
(74) *Attorney, Agent, or Firm* — Novak Druce Connolly Bove + Quigg LLP

(57) ABSTRACT

A cooling fan includes a hub and an impeller. The hub includes a circular wall and an annular wall. The annular wall has a position end opposite to the circular wall. The impeller includes a blade ring and a plurality of blades integrally extending outwards from an outer circumferential surface of the blade ring. The blade ring receives the hub and has a first mounting end and a second mounting end opposite to the first mounting end. When the position end abuts the second mounting end of the blade ring, the blades extend aslant from the blade ring toward a counterclockwise direction relative to the circular wall. When the position end abuts the first mounting end of the blade ring, the blades extend aslant from the blade ring toward a clockwise direction relative to the circular wall.

4 Claims, 4 Drawing Sheets

COOLING FAN WITH IMPELLER

BACKGROUND

1. Technical Field

The present disclosure relates generally to cooling fans, and more particularly to an impeller of a cooling fan.

2. Description of the Related Art

Nowadays, some electronic devices generate much heat when working Such heat can adversely affect the operational stability of the electronic devices. Concretely, an accumulation of the heat in the electronic devices will lead to a temperature increase of the electronic devices, thus resulting in an unstable operation and even a destruction of the electronic devices. Therefore, the heat must be removed in time to keep the temperature of the electronic devices within a safe range. Fans have been used in the electronic devices for providing forced airflows to dissipate the heat.

However, large amount of debris such as dust, dirt, trash, and the like is doped in the airflows. The debris enters the electronic devices following the airflows, and lodges in the electronic devices. Accumulation of the debris baffles the cooling operations of the airflows. A bi-directional fan has been used in the electronic devices for dislodging the debris. The fan can selectively rotate in a clockwise direction or an anti-clockwise direction by a controlling apparatus. However, blades of the bi-directional fan only extend perpendicularly to a hub, but not extend aslant along a rotatable direction of the cooling fan to reduce air noise of the cooling fan.

What is needed, therefore, is a cooling fan with an improved impeller to overcome the above-described limitations.

BRIEF DESCRIPTION OF THE DRAWINGS

The components of the drawings are not necessarily drawn to scale, the emphasis instead being placed upon clearly illustrating the principles of the embodiments of the display device. Moreover, in the drawings, like reference numerals designate corresponding parts throughout several views.

DETAILED DESCRIPTION

Figure 1:
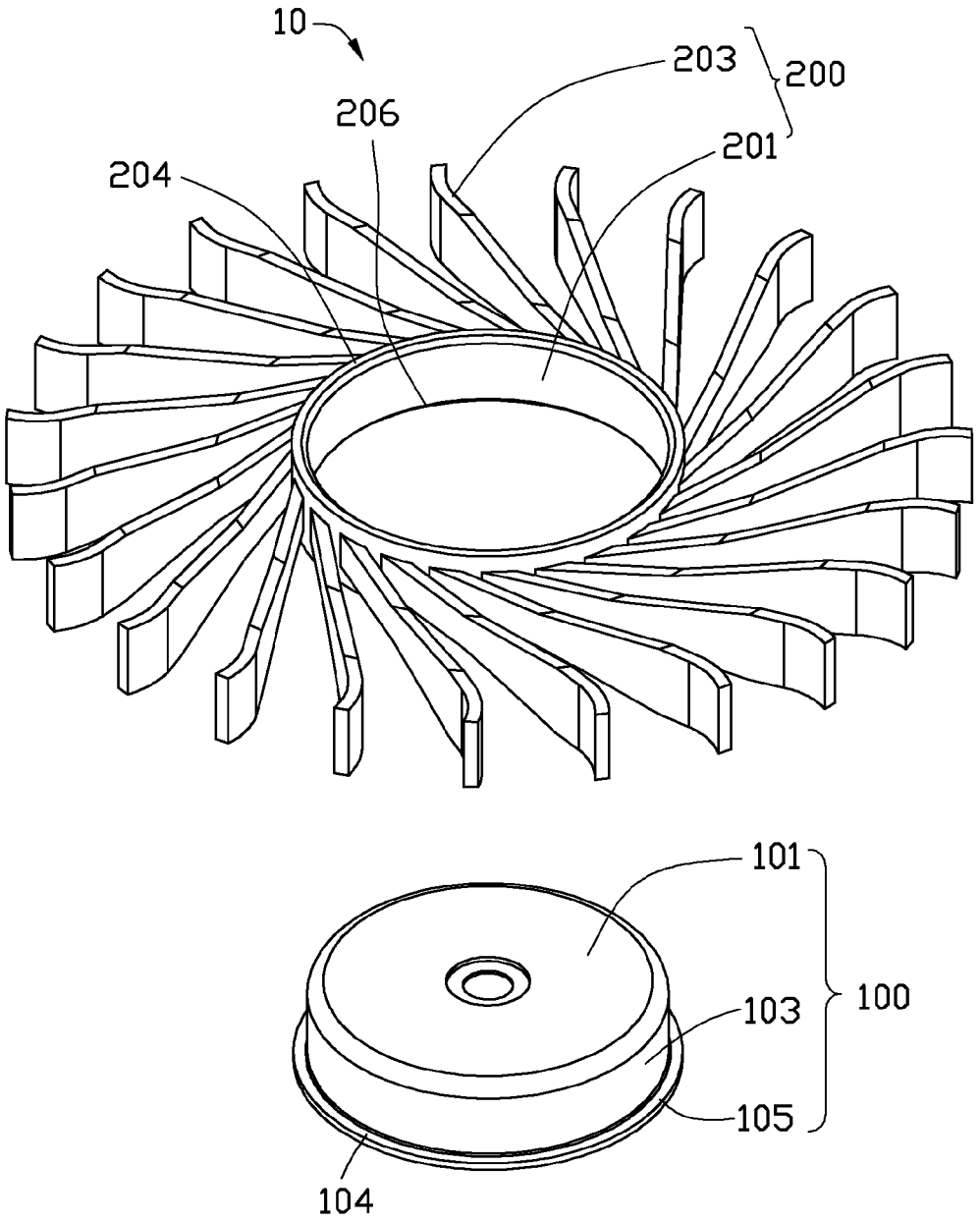
FIG. 1 is an isometric, exploded view of a cooling fan, according to an exemplary embodiment.

Referring to FIG. 1, a cooling fan 10 according to an exemplary embodiment is shown. The cooling fan 10 includes a hub 100 and an impeller 200 surrounding the hub 100.

Figure 2:
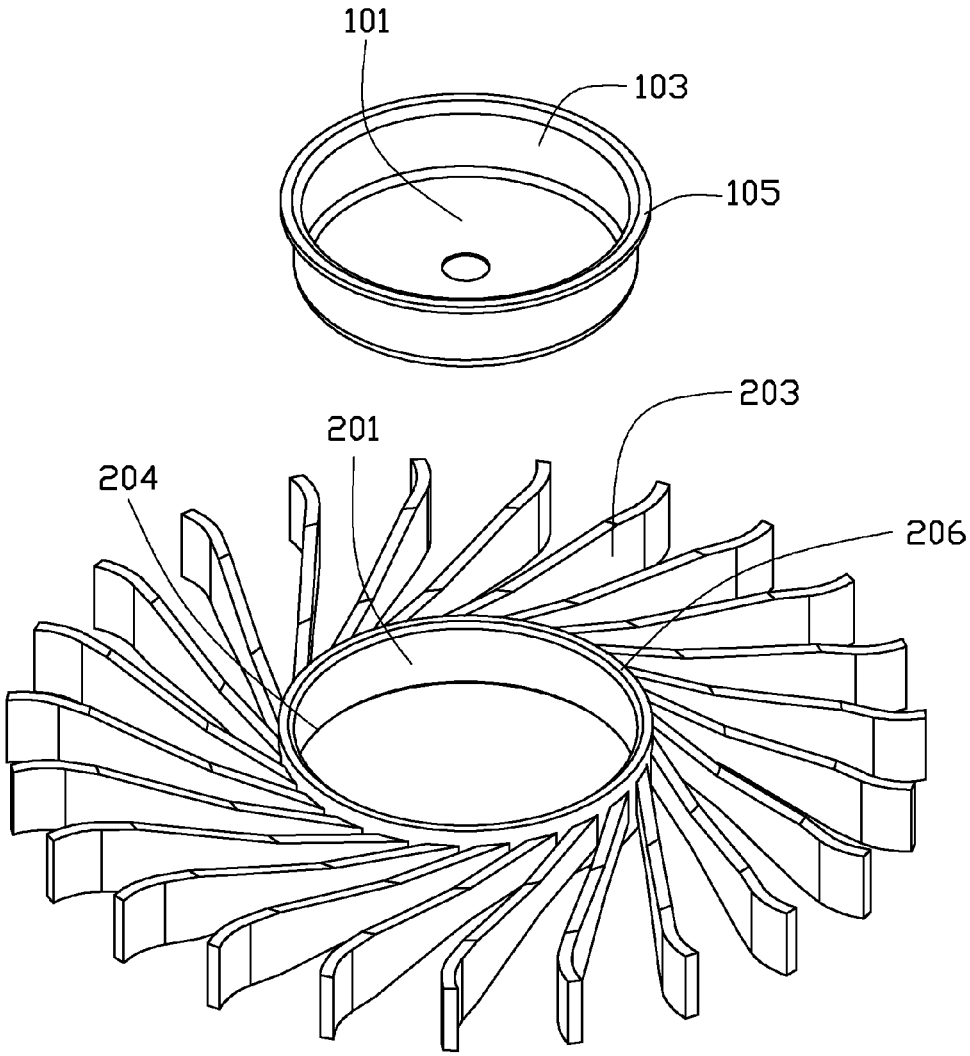
FIG. 2 is an inverted view of the cooling fan of FIG. 1.

Referring to FIG. 2, the hub 100 includes a top circular wall 101, and an annular wall 103 extending perpendicularly and downwards from a periphery of the circular wall 101. The circular wall 101 is fixed to a shaft (not shown) to be rotatable with respect to a stator (not shown) of the cooling fan 10. The annular wall 103 has a position end 104 opposite to the circular wall 101. An annular flange 105 extending perpendicularly from the position end 104.

The impeller 200 and the hub 100 are respectively manufactured. The impeller 200 includes a blade ring 201 and a plurality of blades 203 extending outwards from an outer circumferential surface of the blade ring 201. In this embodiment, the blade ring 201 and the blades 203 are integrally formed by an injection molding process as a single piece. The blade ring 201 has a first mounting end 204 and a second mounting end 206 opposite to the first mounting end 204. The blades 203 extend curvedly from the outer circumferential surface of the blade ring 201 along a counterclockwise direction relative to the first mounting end 204, and along a clockwise direction relative to the second mounting end 206.

Figure 3:
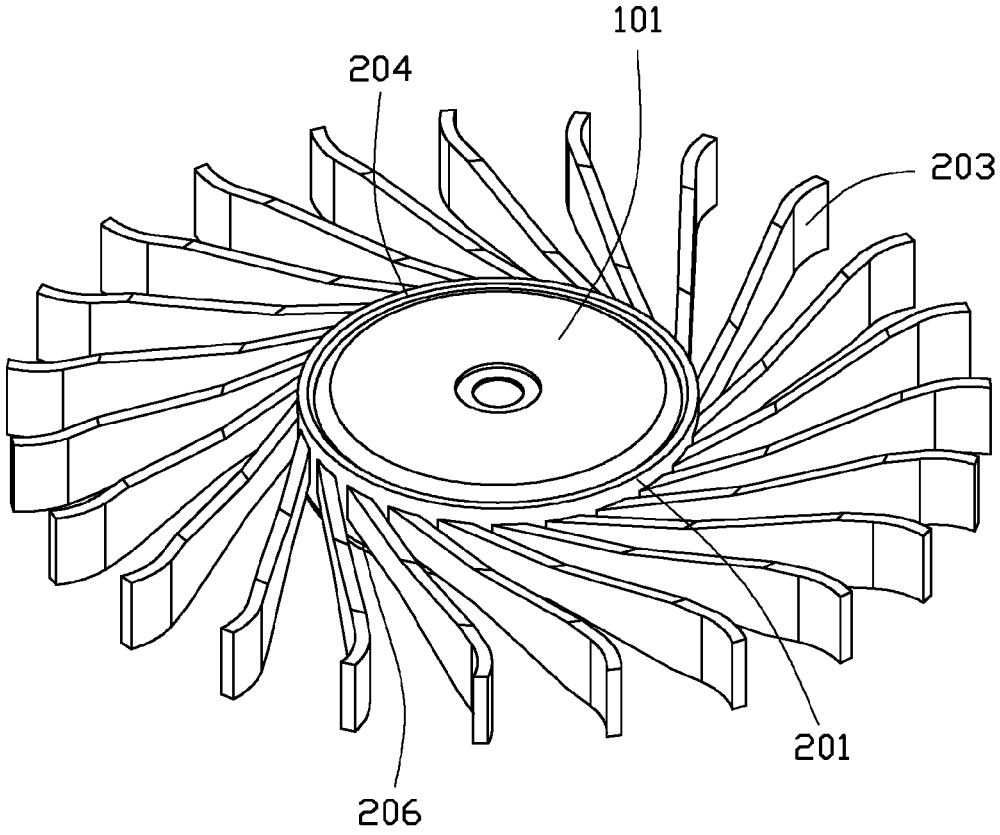
FIG. 3 is an assembled view of the cooling fan of FIG. 1.

Referring to FIG. 3, in a first assembly state, the hub 100 is fixedly received in the blade ring 201 of the impeller 200. The annular wall 103 of the hub 100 tightly contacts an inner surface of the blade ring 201 by gluing. Alternatively, the hub 100 and the blade ring 201 can be combined to each other by clasping structure. The circular wall 101 is located adjoining to the first mounting end 204 of the blade ring 201, and the annular flange 105 of the position end 104 abuts the second mounting end 206 of the blade ring 201. In this state, the blades 203 extend aslant from the blade ring 201 generally toward a counterclockwise direction relative to the first mounting end 204 of the impeller 200 and the circular wall 101 of the hub 100. The cooling fan 10 rotates counterclockwise in the first assembly state.

Figure 4:
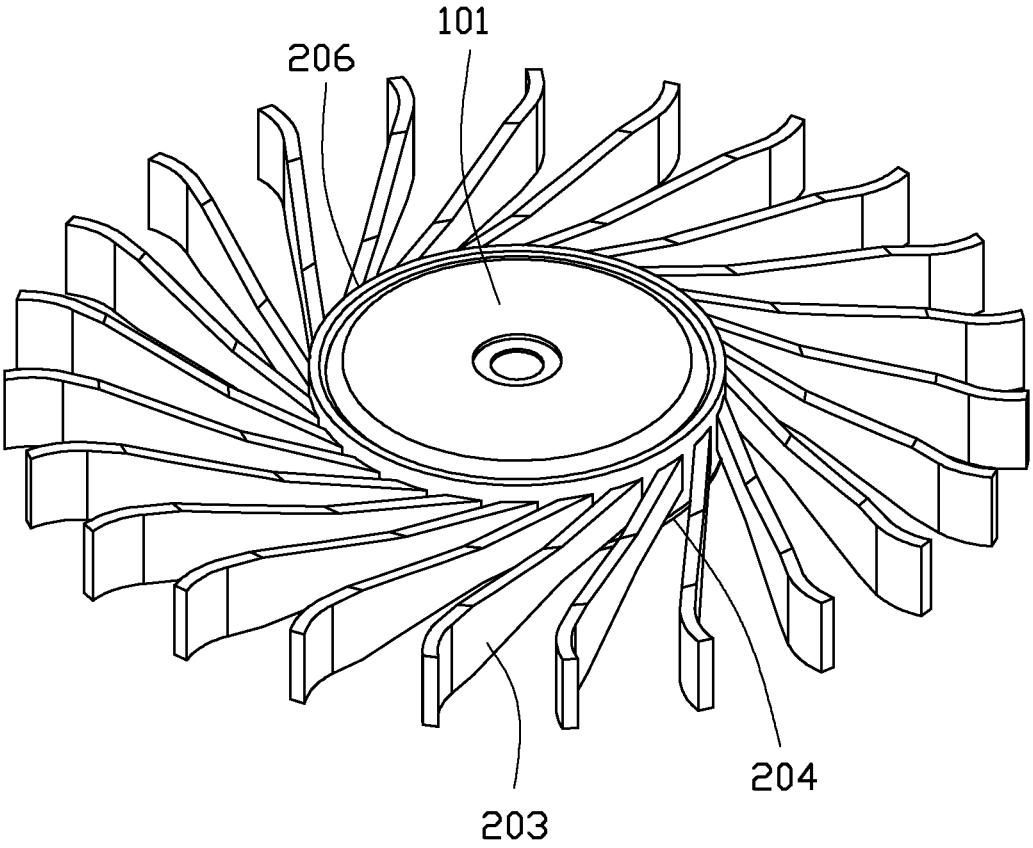
FIG. 4 is an assembled view similar to FIG. 3, but the cooling fan is in a different assembly of a hub and an impeller.

Referring to FIG. 4, in a second assembly state, the impeller 200 is inverted and surrounds the hub 100. The second mounting end 206 of the blade ring 201 is located adjoining to the circular wall 101, and the first mounting end 204 of the blade ring 201 abuts the position end 104. In this state, the blades 203 extend aslant from the blade ring 201 generally toward a clockwise direction relative to the second mounting end 206 of the impeller 200 and the circular wall 101 of the hub 100. In this state, the cooling fan 10 rotates clockwise.

Therefore, the cooling fan 10 can rotate counterclockwise or clockwise in different assembly state between the hub 100 and the impeller 200. The cooling fan 10 is suited for different rotating direction requires, and reduces the cost of manufacturing various fans. Alternatively, the impeller 200 can engage the hub 100 by clasping structure such as claps formed at the annular wall 103 of the hub 100 and groove defined in the inner surface of the blade ring 201.

It is to be further understood that even though numerous characteristics and advantages have been set forth in the foregoing description of the embodiment(s), together with details of the structures and functions of the embodiment(s), the disclosure is illustrative only; and that changes may be made in detail, especially in the matters of shape, size, and arrangement of parts within the principles of the disclosure to the full extent indicated by the broad general meaning of the terms in which the appended claims are expressed.

What is claimed is:

1. A cooling fan, comprising:

a hub comprising a circular wall and an annular wall extending perpendicularly and downwards from a periphery of the circular wall, the annular wall having a position end opposite to the circular wall; and an impeller comprising a blade ring and a plurality of blades extending outwards from an outer circumferential surface of the blade ring, the blade ring receiving the hub and having a first mounting end and a second mounting end opposite to the first mounting end, wherein the hub and the blade ring are connected to each other, the annular wall of the hub contacting an inner surface of the blade ring;

wherein when the position end of the hub abuts the second mounting end of the blade ring, the blades extend aslant from the blade ring toward a counterclockwise direction relative to the circular wall of the hub along a top down perspective; when the position end of the hub abuts the first mounting end of the blade ring, the blades extend aslant from the blade ring toward a clockwise direction relative to the circular wall of the hub along the top down perspective, wherein the hub comprises an annular flange extending perpendicularly from the position end, the annular flange abutting the second end of the hub in a first assembly state and abutting the first end of the hub in a second assembly state.

2. The cooling fan of claim 1, wherein the blade ring and the blades are integrally formed by an injection molding process as a single piece.

3. A cooling fan, comprising:

a hub comprising a circular wall and an annular wall extending perpendicularly and downwards from a periphery of the circular wall; and an impeller comprising a blade ring and a plurality of blades integrally extending outwards from an outer circumferential surface of the blade ring, the blade ring receiving the hub and having a first mounting end and a second mounting end opposite to the first mounting end, the blades extending curvedly from the outer circumferential surface of the blade ring along a counterclockwise direction relative to the first mounting end, and along a clockwise direction relative to the second mounting end, wherein the hub and the blade ring are connected to each other, the annular wall of the hub contacting an inner surface of the blade ring;

wherein when the circular wall of the hub is located adjoining to the first mounting end of the blade ring, the cooling fan rotates counterclockwise in a first assembly state along a top down perspective; when the circular wall of the hub is located adjoining to the second mounting end of the blade ring, the cooling fan rotates clockwise in a second assembly state along the top down perspective, wherein the hub comprises an annular flange extending perpendicularly from an end opposite to the circular wall, the annular flange abutting the second end of the hub in a first assembly state and abutting the first end of the hub in a second assembly state.

4. The cooling fan of claim 3, wherein the blade ring and the blades are integrally formed by an injection molding process as a monolithic piece.

* * * * *